US011339538B2

(12) United States Patent
Lu et al.

(10) Patent No.: US 11,339,538 B2
(45) Date of Patent: May 24, 2022

(54) NANO TIO2-DOPED ANTI-ULTRAVIOLET PARA-ARAMID NANO PAPER AND PREPARATION METHOD THEREOF

(71) Applicant: Shaanxi University of Science & Technology, Xi'an (CN)

(72) Inventors: Zhaoqing Lu, Xi'an (CN); Danni Wang, Xian (CN); Jingyi Nie, Xi'an (CN); Li Hua, Xi'an (CN); Lianmeng Si, Xi'an (CN); Doudou Ning, Xi'an (CN); Yafang Wang, Xi'an (CN); Shanshan Chen, Xi'an (CN)

(73) Assignee: Shaanxi University of Science & Technology, Xian (CN)

( * ) Notice: Subject to any disclaimer, the term of this patent is extended or adjusted under 35 U.S.C. 154(b) by 38 days.

(21) Appl. No.: 16/896,695

(22) Filed: Jun. 9, 2020

(65) Prior Publication Data

US 2021/0017713 A1 Jan. 21, 2021

(30) Foreign Application Priority Data

Jul. 19, 2019 (CN) ..... 201910654832.8

(51) Int. Cl.

| | |
|---|---|
| ***D21H 21/38*** | (2006.01) |
| ***D21H 17/67*** | (2006.01) |
| ***D21H 13/26*** | (2006.01) |
| ***D21H 23/04*** | (2006.01) |

(52) U.S. Cl.

CPC ..... *D21H 17/675* (2013.01); *D21H 13/26* (2013.01); *D21H 21/38* (2013.01); *D21H 23/04* (2013.01)

(58) Field of Classification Search

USPC ..... 162/157.3

See application file for complete search history.

(56) References Cited

U.S. PATENT DOCUMENTS

| | | | | |
|---|---|---|---|---|
| 2004/0009727 | A1* | 1/2004 | Lin | C08J 5/043 442/181 |
| 2009/0142567 | A1* | 6/2009 | Kanakarajan | B32B 5/022 428/220 |
| 2011/0281034 | A1* | 11/2011 | Lee | B82Y 30/00 427/294 |

* cited by examiner

*Primary Examiner* — Mark Halpern

(74) *Attorney, Agent, or Firm* — Mintz Levin Cohn Ferris Glovsky and Popeo, P.C.

(57) ABSTRACT

The disclosure discloses nano $TiO_2$-doped anti-ultraviolet para-aramid nano paper and a preparation method thereof. First, nano $TiO_2$ is selected as an ultraviolet absorbent which has a good absorption effect on ultraviolet rays, and the anti-ultraviolet characteristic of aramid paper-based material can be well improved through addition of nano $TiO_2$. Second, macroscopic para-aramid fiber is dissolved under the action of a DMSO/KOH system, and the surface of the prepared aramid nano fiber is rich in C═O and N—H. This method is simple in process and does not harm the fiber itself, and can effectively improve the mechanical strength, interface binding performance and processability of a base material. The nano $TiO_2$-doped anti-ultraviolet para-aramid nano paper prepared by the disclosure is simple in preparation process, excellent in material property.

14 Claims, 2 Drawing Sheets

NANO TIO2-DOPED ANTI-ULTRAVIOLET PARA-ARAMID NANO PAPER AND PREPARATION METHOD THEREOF

CROSS-REFERENCE TO RELATED APPLICATIONS

The present application claims priority to Chinese Patent Appl. No. 201910654832.8 to Lu et al., filed Jul. 19, 2019 and entitled "Nano $TiO_2$-Doped Anti-Ultraviolet Para-Aramid Nano Paper and Preparation Method Thereof", and incorporates its disclosure herein by reference in its entirety.

TECHNICAL FIELD

The disclosure belongs to the technical field of nano paper, and relates to nano $TiO_2$-doped anti-ultraviolet para-aramid nano paper and a preparation method thereof.

BACKGROUND

A para-aramid paper-based material is a two-dimensional sheet composite material which is prepared by a paper-making wet process based on para-aramid short cut fiber and para-aramid fibrid as raw materials. Due to light weight, high strength, good insulation property, high temperature resistance, flame retardancy and other features, the para-aramid paper-based material is widely used in the fields of aerospace, telecommunication, rail traffic and the like. However, there are two fatal disadvantages in the application process of aramid fiber materials: one of the two fatal disadvantages that the fiber surface is smooth, the active groups are less, and the surface wettability is poor, so as to result in that the binding strength between the fiber and other materials is poor, and then the overall performance of the material is affected; the other of the two fatal disadvantages is that the aramid fiber is a light-sensitive material (an amide bond on a molecular main chain is easy to break), but the aramid fiber is exposed to sunlight in most cases during the application, the aramid fiber itself has poor UV resistance, which will seriously affect the further application of materials in the long run.

SUMMARY

The object of the disclosure is to overcome the disadvantages of the above prior art to provide nano $TiO_2$-doped Anti-ultraviolet para-aramid nano paper and a preparation method thereof. The method is simple in process and does not harm fiber itself, can effectively improve mechanical strength, interface binding performance and processability of a base material and promotes the UV resistance of para-aramid fiber.

In order to achieve the above object, the disclosure is achieved by adopting the following technical solution:

Provided is nano $TiO_2$-doped anti-ultraviolet para-aramid nano paper, and the para-aramid nano paper is doped with nano $TiO_2$; the surface of the aramid nano fiber in the para-aramid nano paper contains C═O and N—H functional groups.

The further improvements of the disclosure are as follows:

Preferably, the average diameter of nano $TiO_2$ in the para-aramid nano paper is 115 nm.

Provided is a preparation method of nano $TiO_2$-doped anti-ultraviolet para-aramid nano paper, comprising the following steps:

Step 1, mixing KH-550, anhydrous ethanol and water, uniformly stirring and adjusting the pH value to 3-5 to obtain KH-550 solution; mixing nano $TiO_2$, water and anhydrous ethanol and ultrasonically dispersing to obtain nano $TiO_2$ dispersion; mixing the nano $TiO_2$ dispersion with the KH-550 solution, uniformly stirring, and centrifuging to obtain a first centrifuged product; re-dispersing the first centrifuged product into dewatered and anhydrous ethanol mixed solution, and centrifuging again; and repeatedly dispersing the centrifuged product into mixed solution of water and anhydrous ethanol, and centrifuging, repeating the above steps for several times, and drying the final centrifuged product to obtain powdery modified nano $TiO_2$;

Step 2, mixing DMSO, para-aramid fibrid and KOH to obtain mixed solution A, and stirring the mixed solution A at room temperature until the color of the mixed solution A is dark red, so as to obtain ANF suspension; and Step 3, adding water in the ANF suspension to obtain defibered ANF suspension; ultrasonically dispersing the powdery modified nano $TiO_2$ in water to obtain ultrasonically dispersed nano $TiO_2$ solution; mixing the ultrasonically dispersed nano $TiO_2$ solution with the defibered ANF suspension, and uniformly stirring to obtain mixed solution B, wherein the mass concentration of nano $TiO_2$ in the mixed solution B is 2%~10%; carrying out suction filtration, squeezing and drying on the mixed solution to obtain the nano $TiO_2$-doped anti-ultraviolet para-aramid nano paper.

Preferably, in Step 1, the mixing volume ratio of KH-550 to anhydrous ethanol to water is 1:(85-95):(5-15).

Preferably, wherein in Step 1, the mixing ratio of nano $TiO_2$ to anhydrous ethanol to water is 1 g:(8.8-13.5) mL:(0.7-1.7) mL.

Preferably, in Step 1, the mixing ratio of nano $TiO_2$ dispersion to KH-550 solution is 1:(8-10).

Preferably, in Step 1, the times of centrifugation is 3-10.

Preferably, in Step 2, the mixing ratio of DMSO to para-aramid fibrid to KOH is (450-550) mL:1 g:(1-2) g.

Preferably, in Step 2, the stirring time of the mixed solution A is 7-10 days.

Preferably, in Step 3, the amount of water added in the ANF suspension is more than 5 times the volume of the ANF suspension.

Compared with the prior art, the disclosure has the following beneficial effects:

The disclosure discloses nano $TiO_2$-doped anti-ultraviolet para-aramid nano paper, the para-aramid nano paper is doped with nano $TiO_2$, and C═O and N—H functional groups are exposed out of the surface of the aramid nano fiber in the para-aramid nano paper so that the functional groups are connected with nano $TiO_2$; as an ultraviolet absorbent, nano $TiO_2$ has a good absorption effect on UV, so it improves the UV resistance of the aramid paper-based material; in the disclosure, since active groups are present on the surface of the para-aramid nano fiber, the interface binding performance and processability of the paper-based material are enhanced, and the nano $TiO_2$-doped anti-UV para-aramid nanopaper material has excellent property.

The disclosure also discloses a preparation method of nano $TiO_2$-doped anti-UV para-aramid nano paper. In the preparation method, first, nano $TiO_2$ is modified by KH-550 to graft a hydrophobic long chain on the surface of nano $TiO_2$, so as to reduce its surface energy, the modified nano $TiO_2$ has good dispersivity, is not easy to agglomerate, and is convenient to disperse in nano paper in the next step. Through treatment of para-aramid fibrid with DMSO/KOH, deprotonation occurs in this system to remove hydrogen at the position of amido bond and destroy the original hydrogen bond structure in the aramid fiber, so that aramid fiber is dissolved and then aramid nano fiber is formed, the exposed C═O and N—H groups are obtained. Meanwhile, the method does not damage the fiber itself. After modified $TiO_2$ and nano fiber are mixed, the nano $TiO_2$-doped anti-UV para-aramid nano paper is prepared. The method is simple in preparation process, and the nano $TiO_2$ which is low in price, green, non-toxic and excellent in property is selected as the UV absorbent, which meets the requirements of environmental protection.

Further, KH-550 and nano $TiO_2$ are respectively dissolved or dispersed through mixed solution of anhydrous ethanol and mixed to obtain KH-550 and nano $TiO_2$ dispersion. In the mixing process, KH-550 can effectively modify nano $TiO_2$.

Further, the centrifuged product is washed by the mixed solution of ethanol and water to sufficiently remove KH-550 which is remained on the surface of nano $TiO_2$ after modification.

Further, deprotonation is carried out on the para-aramid fibrid is carried out through KOH, and the whole process lasts for about one week. H on the amide bond is removed to destroy a large number of hydrogen bonds in the molecular chain of the aramid fiber, so that the macroscopic fiber becomes nano fiber.

Figure 2:
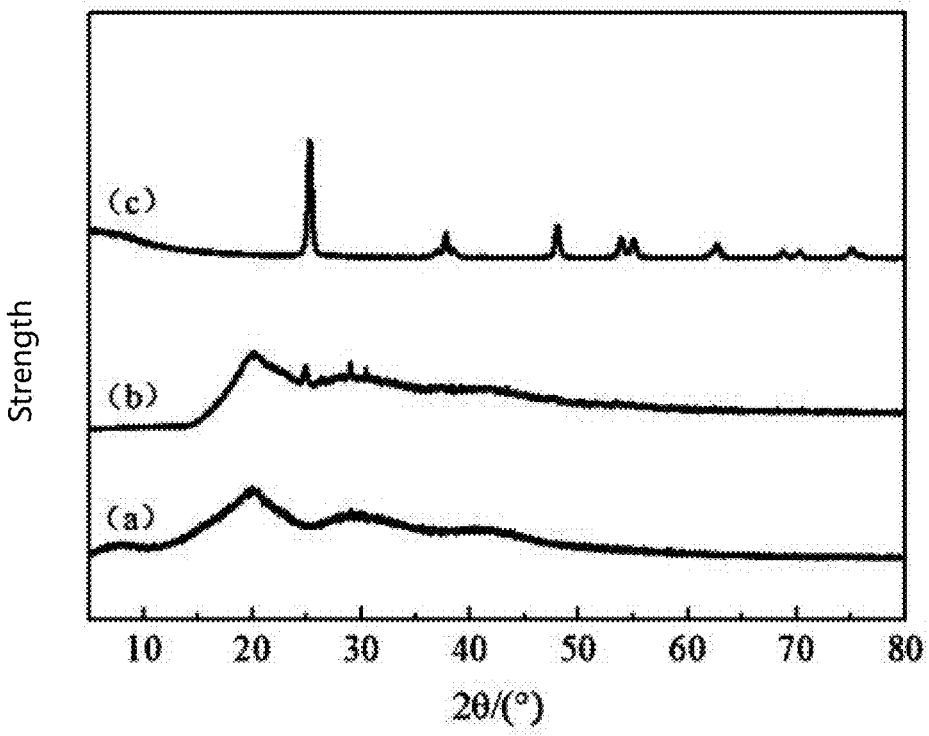
Figure 3:
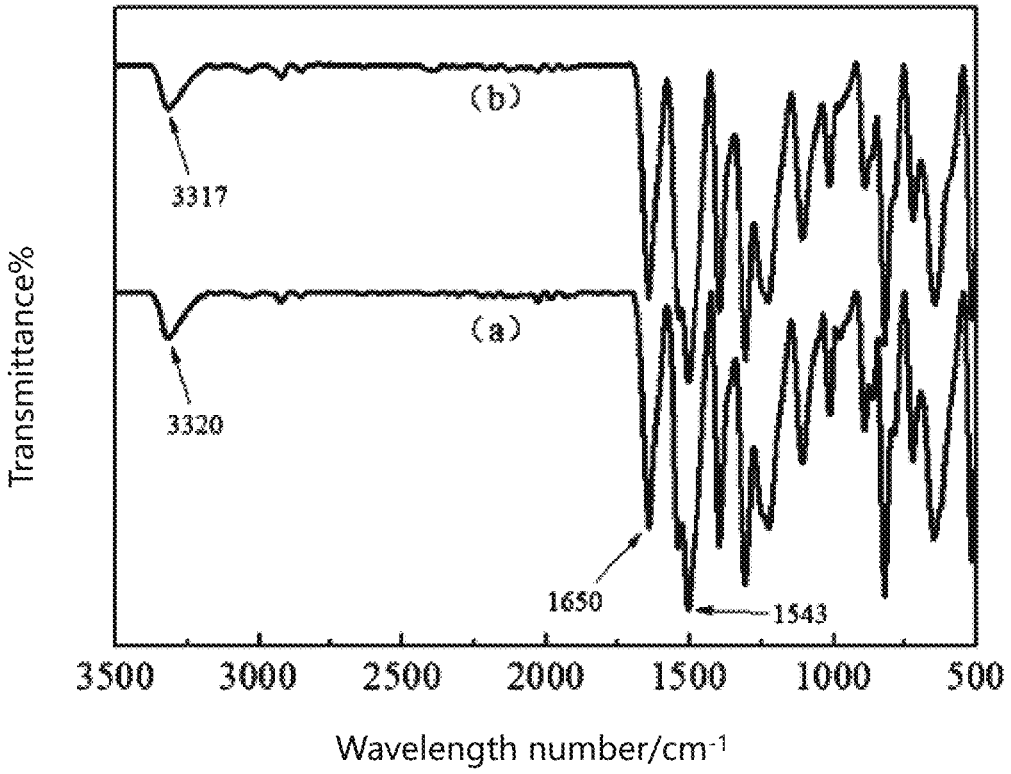
Figure 4:
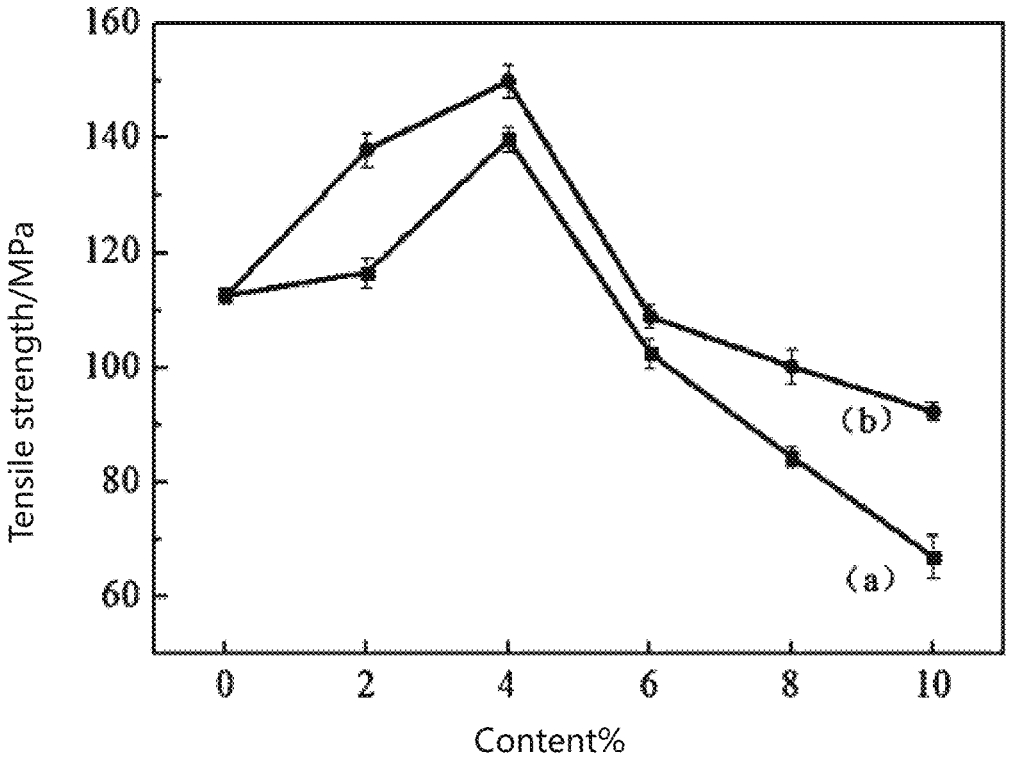

wherein, (a) is the original ANF paper, and (b) is the nano composite paper added with 4% of nano $TiO_2$;

FIG. 2 is an XRD image of original ANF paper and nano composite paper added with nano $TiO_2$ according to embodiment 1 of the disclosure, wherein, (a) refers to the original ANF paper; (b) refers to the composite paper added with 4% of nano $TiO_2$; (c) refers to nano $TiO_2$;

FIG. 3 is an FT-IR image of original ANF paper and nano composite paper added with nano $TiO_2$ according to embodiment 5 of the disclosure, wherein, (a) refers to the original ANF paper, and (b) refers to the nano composite paper added with 2% of nano $TiO_2$; and FIG. 4 is a tensile strength graph of original ANF paper and nano composite paper added with nano $TiO_2$ according to the disclosure, wherein, (a) refers to paper before UV irradiation; (b) refers to paper after UV irradiation.

DESCRIPTION OF THE EMBODIMENTS

The disclosure will be described in detail in combination with drawings and embodiments. The disclosure discloses a nano $TiO_2$-doped anti-ultrasonic para-aramid nano paper and a preparation method thereof. The para-aramid nano paper is doped with nano $TiO_2$, the average size of nano $TiO_2$ is 115 nm, and the surface of the aramid nano fiber in the para-aramid nano paper contains a large number of C═O and N—H functional groups which have certain activity and can be connected with hydroxyl on the surface of nano $TiO_2$ by means of a hydrogen bond. Raw materials are prepared before preparation, including para-aramid fibrid (ANF), nano $TiO_2$, potassium hydroxide (KOH), dimethyl sulfoxide (DMSO), γ-aminopropyltriethoxy silane (KH-550), anhydrous ethanol and deionized water; the preparation method specifically comprises the following steps:

Step 1: Modification of Nano $TiO_2$;

Anhydrous ethanol, deionized water and KH-550 are taken, and mixed (a mixing volume ratio of (85-95):(5-15):1) and stirred at 60-70° C. and then put in a three-neck flask, and the pH value is adjusted to 3-5 with hydrochloric acid and sodium hydroxide solution, so as to obtain KH-550 solution; nano $TiO_2$, anhydrous ethanol and deionized water are mixed (a mixing ratio of 1 g:(8-13.5) mL:(0.7-1.7) mL) and ultrasonically dispersed for 5 min to obtain ultrasonically dispersed nano $TiO_2$ suspension; the dispersed nano $TiO_2$ suspension is poured into the three-neck flask, wherein the mixing volume ratio of the nano $TiO_2$ suspension to KH-550 solution is 1:(8-10), the nano $TiO_2$ suspension and the KH-550 solution are stirred for 1 h at a constant speed at 60-70° C. to obtain the mixed solution, the mixed solution is centrifuged to obtained the centrifuged product, and then the centrifuged product is dispersed in the mixed solution of deionized water and anhydrous ethanol again, and the above steps are repeated for several times with total centrifugation for 3-10 times; KH550 on the surface of the modified nano $TiO_2$ is removed by repeated centrifugation, and the final centrifuged product is dried in a 100° C. oven for 6 hours to obtain the modified nano $TiO_2$ which is grinded into powder for later user.

Step 2: Preparation of ANF Suspension

According to the proportion of (450-550) mL:1 g:(1:2) g, DMSO, para-aramid fibrid and KOH are mixed to obtain mixed solution A, and then the mixed solution A is stirred at room temperature for 7-10 days until the solution was dark red to obtain ANF suspension.

Step 3: Preparation of Nano $TiO_2$-Doped Para-Aramid Nano Paper

1) ANF suspension is taken and defibered by adding water, wherein the addition amount of water is more than 5 times of the volume of ANF suspension, so that DMSO is diluted with water in a solvent;

2) the powdery modified nano $TiO_2$ is dispersed in water to obtain the ultrasonically dispersed nano $TiO_2$ solution; the ultrasonically dispersed nano $TiO_2$ solution and the defibered ANF suspension are uniformly stirred to obtain mixed solution B; the mass concentration of nano $TiO_2$ in the mixed solution B is 2%~10%; the mixed solution B is filtered at reduced, pressed and dried to obtain the nano $TiO_2$-doped para-aramid nano paper.

Example 1

Step 1: 90 mL of anhydrous ethanol, 10 mL of deionized water and 1 mL of KH-550 were taken, mixed and stirred at 60° C. and the put in a three-neck flask, and the pH value was adjusted to about 4 with hydrochloric acid and sodium hydroxide solution; 1 g of nano $TiO_2$ was weighed and added into mixed solution of 1 mL of deionized water and 9 mL of anhydrous ethanol, the above mixture was ultrasonically dispersed at a high speed for 5 min to obtain ultrasonically dispersed nano $TiO_2$ suspension; the dispersed nano $TiO_2$ was poured into the three-neck flask, the mixing volume ratio of nano $TiO_2$ suspension to KH-550 solution was 1:8, and the mixed solution was obtained after stirring at 60° C. for 1 h at a constant speed. After centrifugation, the above mixed solution was dispersed again in the mixed solution of deionized water and anhydrous ethanol, such the steps were repeated for 5 times, and the above dispersion was dried in an oven at 100° C. for 6 h and then grinded, so that the modified $TiO_2$ solution was obtained;

Step 2: 500 mL of DMSO solution was taken and added with 1.0 g of para-aramid fibrid and 1.5 g of KOH and then stirred at room temperature for 7 days, until the solution is dark red, and ANF suspension was obtained.

Step 3: 100 mL of ANF solution was taken and added with 500 mL of water to be defibered; the modified $TiO_2$ solution prepared in step 1 was ultrasonically dispersed in water to obtain the ultrasonically dispersed nano-$TiO_2$ solution; the ultrasonically dispersed nano $TiO_2$ solution and the defibered ANF suspension were uniformly stirred to obtain the mixed solution B; the mass concentration of nano $TiO_2$ in the mixed solution B was 4%; the mixed solution B was filtered at reduced pressure, squeezed and dried to obtain nano $TiO_2$-doped para-aramid nano paper.

Figure 1:
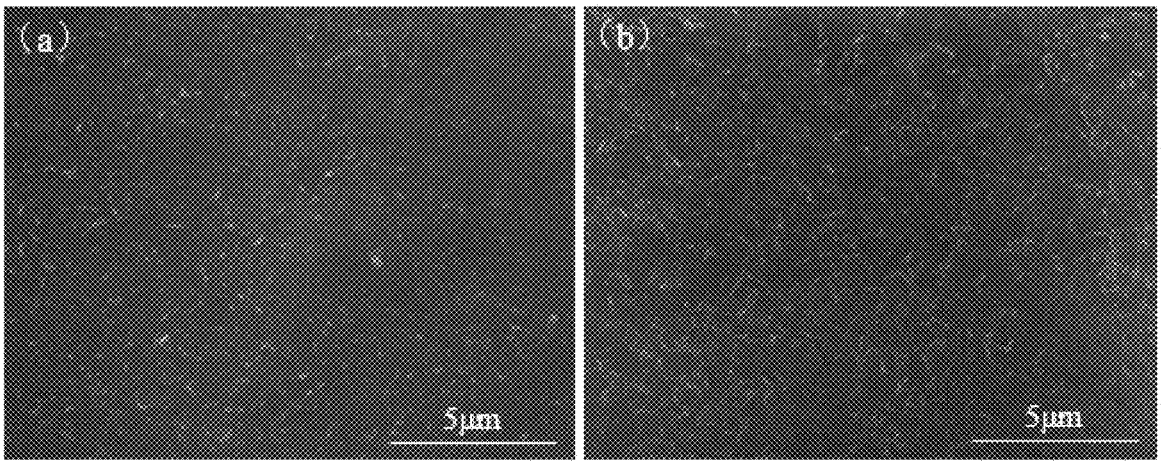
FIG. 1 is an SEM image of original ANF paper and nano composite paper added with nano $TiO_2$ according to embodiment 1 of the disclosure.

The SEM graph of the nano $TiO_2$-doped para-aramid nano paper prepared in this embodiment is seen in FIG. 1. It can be seen from FIG. 1 that after adding nano $TiO_2$, the surface of the paper obviously changes. Some particles and fine fibers are scattered on the surface of the paper, and the surface of the paper becomes rough.

It can be seen from the XRD image in FIG. 2 that there is only one very wide dispersion peak in pure ANF paper, and three characteristic peaks of $TiO_2$ powder appear in ANF/nano $TiO_2$ paper, namely, 25.31°, 37.85° and 48.18° in the drawing, which correspond to the reflection peaks of (101), (004) and (200) crystal faces of $TiO_2$ respectively. It can be shown that nano $TiO_2$ particles were successfully doped into ANF paper, and the crystal structure of $TiO_2$ crystal powder in ANF/nano $TiO_2$ paper is not damaged and kept intact.

It can be seen from FIG. 3 that from the infrared image of ANF, it can be seen that the absorption peak at 3320 $cm^{-1}$ is the stretching vibration of the N—H bond, the absorption peak at 1650 cm-1 is the stretching vibration of amide I, and the absorption peak at 1543 $cm^{-1}$ is the stretching vibration of amide II. Compared with ANF paper, a large number of hydroxyl groups are present on the surface of nano $TiO_2$ particles due to the introduction of a large number of nano $TiO_2$ particles inside the nano composite paper, there is hydrogen bond interaction between these hydroxyl groups and —C═O and —N—H in the ANF molecule, and the existence of hydrogen bond can make the position of the absorption peak in the infrared spectrum changed. It can be seen from the drawing that the hydrogen bond effect makes the stretching vibration absorption band of the N—H bond in the composite paper move to low frequency, which also confirms the existence of $TiO_2$ in composite paper.

FIG. 4 shows the change in tensile strength of ANF base paper and ANF/nano $TiO_2$ paper before and after aging for 72 hours. It can be seen from the drawing that when the addition amount of nano $TiO_2$ reaches 4%, the fracture stress reaches a peak value, which is increased by 24.49% from the original 113.586 MPa to 141.405 MPa. After UV irradiation, the maximum fracture stress is 149.933 MPa, which is increased by 32.52% compared with ANF base paper and 6.03% compared with that before UV irradiation. The reason may be that under the action of ultraviolet, the amide bond of ANF partially breaks and active groups such as —C═O and —N—H are exposed from the surface of ANF. The hydrogen bond interaction is formed between the active groups and the hydroxyl group on the surface of nano $TiO_2$, which enhances combination between them and increases the fracture stress of the material. It is also possible that the long-time ultraviolet irradiation causes some small pores on the fiber surface, increases the roughness of the fiber surface, and meanwhile enhances the adhesion of nano $TiO_2$ on the fiber surface so as to increase the roughness of the fiber surface, thereby improving the friction performance of the fiber, and then improving the mechanical properties of the paper-based materials.

Example 2

Step 1: 85 mL of anhydrous ethanol, 10 mL of deionized water and 1 mL of KH-550 were taken, mixed and stirred at 60° C. and the put in a three-neck flask, the pH value was adjusted to about 4 with hydrochloric acid and sodium hydroxide solution; 1 g of nano $TiO_2$ was weighed and added into mixed solution of 1.2 mL of deionized water and 10 mL of anhydrous ethanol, the above mixture was ultrasonically dispersed at a high speed for 5 min to obtain ultrasonically dispersed nano $TiO_2$ suspension; the dispersed nano $TiO_2$ was poured into the three-neck flask, the mixing volume ratio of nano $TiO_2$ suspension to KH-550 solution was 1:10, and the mixed solution was obtained after stirring at 70° C. for 1 h at a constant speed. After centrifugation, the above mixed solution was dispersed again in the mixed solution of deionized water and anhydrous ethanol, such the steps were repeated for 3 times, the above dispersion was dried in an oven at 100° C. for 6 h and then grinded, so that the modified $TiO_2$ solution was obtained;

Step 2: 450 mL of DMSO solution was taken and added with 1.0 g of para-aramid fibrid and 2 g of KOH and then stirred at room temperature for 8 days, until the solution is dark red, and ANF suspension was obtained.

Step 3: 100 mL of ANF solution was taken and added with 600 mL of water to be defibered; the modified $TiO_2$ solution prepared in step 1 was ultrasonically dispersed in water to obtain the ultrasonically dispersed nano-$TiO_2$ solution; the ultrasonically dispersed nano $TiO_2$ solution and the defibered ANF suspension were uniformly stirred to obtain the mixed solution B; the mass concentration of nano $TiO_2$ in the mixed solution B was 6%; the mixed solution B was filtered at reduced pressure, pressed and dried to obtain nano $TiO_2$-doped para-aramid nano paper.

Example 3

Step 1: 90 mL of anhydrous ethanol, 15 mL of deionized water and 1 mL of KH-550 were taken, mixed and stirred at 65° C. and the put in a three-neck flask, the pH value was adjusted to about 5 with hydrochloric acid and sodium hydroxide solution; 1 g of nano $TiO_2$ was weighed and added into mixed solution of 1.7 mL of deionized water and 10 mL of anhydrous ethanol, the above mixture was ultrasonically dispersed at a high speed for 5 min to obtain ultrasonically dispersed nano $TiO_2$ suspension; the dispersed nano $TiO_2$ was poured into the three-neck flask, the mixing volume ratio of nano $TiO_2$ suspension to KH-550 solution was 1:9, and the mixed solution was obtained after stirring at 60° C. for 1 h at a constant speed. After centrifugation, the above mixed solution was dispersed again in the mixed solution of deionized water and anhydrous ethanol, such the steps were repeated for 10 times, and the above dispersion was dried in an oven at 100° C. for 6 h and then grinded, so that the modified $TiO_2$ solution was obtained;

Step 2: 480 mL of DMSO solution was taken and added with 1.0 g of para-aramid fibrid and 1 g of KOH and then stirred at room temperature for 9 days, until the solution is dark red, and ANF suspension was obtained.

Step 3: 100 mL of ANF solution was taken and added with 800 mL of water to be defibered; the modified $TiO_2$ solution prepared in step 1 was ultrasonically dispersed in water to obtain the ultrasonically dispersed nano-$TiO_2$ solution; the ultrasonically dispersed nano $TiO_2$ solution and the defibered ANF suspension were uniformly stirred to obtain the mixed solution B; the mass concentration of nano $TiO_2$ in the mixed solution B was 8%; the mixed solution B was filtered at reduced pressure, pressed and dried to obtain nano $TiO_2$-doped para-aramid nano paper.

Example 4

Step 1: 95 mL of anhydrous ethanol, 5 mL of deionized water and 1 mL of KH-550 were taken, mixed and stirred at 60° C. and the put in a three-neck flask, the pH value was adjusted to about 3 with hydrochloric acid and sodium hydroxide solution; 1 g of nano $TiO_2$ was weighed and added into mixed solution of 0.7 mL of deionized water and 13.5 mL of anhydrous ethanol, the above mixture was ultrasonically dispersed at a high speed for 5 min to obtain ultrasonically dispersed nano $TiO_2$ suspension; the dispersed nano $TiO_2$ was poured into the three-neck flask, the mixing volume ratio of nano $TiO_2$ suspension to KH-550 solution was 1:8, and the mixed solution was obtained after stirring at 60° C. for 1 h at a constant speed. After centrifugation, the above mixed solution was dispersed again in the mixed solution of deionized water and anhydrous ethanol, such the steps were repeated for 6 times, and the above dispersion was dried in an oven at 100° C. for 6 h and then grinded, so that the modified $TiO_2$ solution was obtained;

Step 2: 470 mL of DMSO solution was taken and added with 1.0 g of para-aramid fibrid and 1.5 g of KOH and then stirred at room temperature for 10 days, until the solution is dark red, and ANF suspension was obtained.

Step 3: 100 mL of ANF solution was taken and added with 600 mL of water to be defibered; the modified $TiO_2$ solution prepared in step 1 was ultrasonically dispersed in water to obtain the ultrasonically dispersed nano-$TiO_2$ solution; the ultrasonically dispersed nano $TiO_2$ solution and the defibered ANF suspension were uniformly stirred to obtain the mixed solution B; the mass concentration of nano $TiO_2$ in the mixed solution B was 2%; the mixed solution B was filtered at reduced pressure, pressed and dried to obtain nano $TiO_2$-doped para-aramid nano paper.

Example 5

Step 1: 88 mL of anhydrous ethanol, 10 mL of deionized water and 1 mL of KH-550 were taken, mixed and stirred at 60° C. and the put in a three-neck flask, the pH value was adjusted to about 4 with hydrochloric acid and sodium hydroxide solution; 1 g of nano $TiO_2$ was weighed and added into mixed solution of 1 mL of deionized water and 8.8 mL of anhydrous ethanol, the above mixture was ultrasonically dispersed at a high speed for 5 min to obtain ultrasonically dispersed nano $TiO_2$ suspension; the dispersed nano $TiO_2$ was poured into the three-neck flask, the mixing volume ratio of nano $TiO_2$ suspension to KH-550 solution was 1:10, and the mixed solution was obtained after stirring at 60° C. for 1 h at a constant speed. After centrifugation, the above mixed solution was dispersed again in the mixed solution of deionized water and anhydrous ethanol, such the steps were repeated for 6 times, the above dispersion was dried in an oven at 100° C. for 6 h and then grinded, so that the modified $TiO_2$ solution was obtained;

Step 2: 550 mL of DMSO solution was taken and added with 1.0 g of para-aramid fibrid and 2 g of KOH and then stirred at room temperature for 8 days, until the solution is dark red, and ANF suspension was obtained.

Step 3: 100 mL of ANF solution was taken and added with 600 mL of water to be defibered; the modified $TiO_2$ solution prepared in step 1 was ultrasonically dispersed in water to obtain the ultrasonically dispersed nano-$TiO_2$ solution; the ultrasonically dispersed nano $TiO_2$ solution and the defibered ANF suspension were uniformly stirred to obtain the mixed solution B; the mass concentration of nano $TiO_2$ in the mixed solution B was 10%; the mixed solution B was filtered at reduced pressure, pressed and dried to obtain nano $TiO_2$-doped para-aramid nano paper.

The above descriptions are only preferred embodiments of the disclosure but not intended to limit the disclosure. Any modifications, equivalent substitutions, improvements and the like made without departing from the spirit and principle of the disclosure are all included within the scope of protection of the disclosure.

What is claimed:

1. A preparation method of nano $TiO_2$-doped anti-ultraviolet para-aramid nano paper, comprising the following steps:

step 1:

mixing γ-aminopropyltriethoxy silane, anhydrous ethanol and water, stirring and adjusting the pH value to 3-5, thereby obtaining a γ-aminopropyltriethoxy silane solution;

mixing nano $TiO_2$, water and anhydrous ethanol and ultrasonically dispersing to obtain a nano $TiO_2$ dispersion;

mixing the nano $TiO_2$ dispersion with the γ-aminopropyltriethoxy silane solution, stirring, and centrifuging to obtain a first centrifuged product;

re-dispersing the first centrifuged product into a mixed solution of water and anhydrous ethanol, and centrifuging again; and repeatedly dispersing the centrifuged product into a mixed solution of water and anhydrous ethanol and centrifuging, repeating the above steps, and drying the final centrifuged product to obtain a powdery modified nano $TiO_2$;

step 2:

mixing dimethyl sulfoxide, para-aramid fibrid and KOH to obtain mixed solution A, stirring the mixed solution A at room temperature until the color of the mixed solution A is changed to dark red, so as to obtain a para-aramid fibrid suspension; and step 3:

adding water to the para-aramid fibrid suspension and defibering to obtain a defibered para-aramid fibrid suspension;

ultrasonically dispersing the powdery modified nano $TiO_2$ in water to obtain an ultrasonically dispersed nano $TiO_2$ solution;

mixing the ultrasonically dispersed nano $TiO_2$ solution with the defibered para-aramid fibrid suspension, and stirring to obtain mixed solution B, wherein a mass concentration of nano $TiO_2$ in the mixed solution B is 2%~10%;

carrying out a suction filtration, squeezing and drying on the mixed solution B to obtain the nano $TiO_2$-doped anti-ultraviolet para-aramid nano paper.

2. The preparation method of nano $TiO_2$-doped anti-ultraviolet para-aramid nano paper according to claim 1, wherein in step 1, a mixing volume ratio of the γ-aminopropyltriethoxy silane, anhydrous ethanol, and water is 1:(85-95):(5-15), respectively.

3. The preparation method of nano $TiO_2$-doped anti-ultraviolet para-aramid nano paper according to claim 2, wherein in step 3, the water added to the para-aramid fibrid suspension is more than 5 times the volume of the para-aramid fibrid suspension.

4. The preparation method of nano $TiO_2$-doped anti-ultraviolet para-aramid nano paper according to claim 1, wherein in step 1, a mixing ratio of the nano $TiO_2$, anhydrous ethanol, and water is 1 g:(8.8-13.5) mL:(0.7-1.7) mL, respectively.

5. The preparation method of nano $TiO_2$-doped anti-ultraviolet para-aramid nano paper according to claim 4, wherein in step 3, the water added to the para-aramid fibrid suspension is more than 5 times the volume of the para-aramid fibrid suspension.

6. The preparation method of nano $TiO_2$-doped anti-ultraviolet para-aramid nano paper according to claim 1, wherein in step 1, a mixing volume ratio of the nano $TiO_2$ dispersion to the γ-aminopropyltriethoxy silane solution is 1:(8-10).

7. The preparation method of nano $TiO_2$-doped anti-ultraviolet para-aramid nano paper according to claim 6, wherein in step 3, the water added to the para-aramid fibrid suspension is more than 5 times the volume of the para-aramid fibrid suspension.

8. The preparation method of nano $TiO_2$-doped anti-ultraviolet para-aramid nano paper according to claim 1, wherein in step 1, the centrifuging is performed for 3-10 times.

9. The preparation method of nano $TiO_2$-doped anti-ultraviolet para-aramid nano paper according to claim 8, wherein in step 3, the water added to the para-aramid fibrid suspension is more than 5 times the volume of the para-aramid fibrid suspension.

10. The preparation method of nano $TiO_2$-doped anti-ultraviolet para-aramid nano paper according to claim 1, wherein in step 2: a mixing ratio of dimethyl sulfoxide, para-aramid fibrid, and KOH is (450-550) mL:1 g:(1-2) g, respectively.

11. The preparation method of nano $TiO_2$-doped anti-ultraviolet para-aramid nano paper according to claim 10, wherein in step 3, the water added to the para-aramid fibrid suspension is more than 5 times the volume of the para-aramid fibrid suspension.

12. The preparation method of nano $TiO_2$-doped anti-ultraviolet para-aramid nano paper according to claim 1, wherein in step 2: the stirring the mixed solution A is performed for 7-10 days.

13. The preparation method of nano $TiO_2$-doped anti-ultraviolet para-aramid nano paper according to claim 12, wherein in step 3, the water added to the para-aramid fibrid suspension is more than 5 times the volume of the para-aramid fibrid suspension.

14. The preparation method of nano $TiO_2$-doped anti-ultraviolet para-aramid nano paper according to claim 1, wherein in step 3, the water added to the para-aramid fibrid suspension is more than 5 times the volume of the para-aramid fibrid suspension.

* * * * *